United States Patent [19]

Fortier

[11] 4,323,272

[45] Apr. 6, 1982

[54] EXCREMENT PICKUP DEVICE

[76] Inventor: J. Paul Fortier, 6220 Dartmouth Ave. N., St. Petersburg, Fla. 33710

[21] Appl. No.: 121,677

[22] Filed: Feb. 15, 1980

[51] Int. Cl.[3] ..... A01K 29/00

[52] U.S. Cl. ..... 294/1 BA; 294/99 R

[58] Field of Search ..... 294/1 B, 1 BA, 1 BB, 294/19 A, 28, 33, 50.8, 55, 99 R; 15/104.8, 257.1, 257.4, 257.6; 150/1, 1.8, 2; 229/53, 62; 248/95, 99

[56] References Cited

U.S. PATENT DOCUMENTS

| | | | |
|---|---|---|---|
| 863,963 | 8/1907 | Asplund | 248/99 |
| 1,267,336 | 5/1918 | Bubb | 294/99 R |
| 2,505,289 | 4/1950 | Haslett | 294/99 R X |
| 3,281,178 | 10/1966 | Fisher | 294/1 BA |
| 3,446,525 | 5/1969 | Jones | 294/1 BA |
| 3,606,436 | 9/1971 | Lynch | 294/1 BA |
| 3,716,263 | 2/1973 | Gatti | 294/1 BA |
| 3,767,247 | 10/1973 | Wetzler | 294/1 B |
| 3,819,220 | 6/1974 | Bredt | 294/1 BB |

*Primary Examiner*—Johnny D. Cherry

*Attorney, Agent, or Firm*—Walter J. Kreske

[57] ABSTRACT

A hand portable and single hand operable device for picking up animal excrement and the like comprised of a pair of metal rods fixed close enough together at one end as V shaped extensions from a spring loop to form a handle portion for grasping with one hand about both rods which are deflectable toward each other by pressure of the hand. At the other end of each of the rods is a bag support member comprised of an elongated bag support wire loop formation having two substantially parallel width portions and two opposed length portions with the length portion farthest from the handle portion in each bag support loop formation being straight and parallel to each other and moveable toward each other into line contact with each other by deflection of the rods. A bag having flexible sidewalls and an opening with a cuff about its periphery is mounted by the cuff on the respective bag support wire loop formation in manner that the opening is at and controlled by the parallel straight portions of the bag support loop formations.

11 Claims, 10 Drawing Figures

EXCREMENT PICKUP DEVICE

BACKGROUND OF THE INVENTION (1) Field of the Invention

Hand portable and single hand operable device for picking up and transporting animal excrement and the like.

(2) Description of the Prior Art

In urban areas there is an increasing insistance on owners of pets such as dogs to clean up excrement left by their pets in public places. Some communities have enacted legislation making such cleanup a mandatory obligation of the pet owner. Since such communities also usually have "pet leash laws," the need for excrement pickup and transport most often occurs when a pet dog is being walked by its master under control of a leash held in one hand. Thus only the other hand is normally available for carrying and operating a device for pickup and transport of the pet's excrement. It therefor becomes desirable that such device be very light in weight for easy carrying, easy to operate with one hand, and comprised of a minimum number of moving components to thereby minimize possible malfunction and cost of manufacture.

Devices heretofore invented for picking up excrement have generally failed to meet one or more of the above mentioned desirable requirements. While some require the use of two hands for their operation, they all generally involve a relatively large number of moving parts which result in a relatively expensive and complicated assembly which is dependent for its operation of each of its plurality of moving parts, any one of which may cause the overall device to malfunction.

SUMMARY OF THE INVENTION

These problems have been overcome by the present invention of a hand portable device for picking up and transporting animal excrement and the like which is not only light in weight and easy to carry and operate with one hand, but also has the reliability of basically a single component bag manipulating structure as well as other desirable features and advantages. Among the other desirable features and advantages of the present invention is the provision of a hand portable device having capacity for safely making a plurality of such excrement pickups even though previous picked up material is still in the bag. Another feature and advantage is the provision of a device which is operable with a single hand on the handle to perform the functions of opening the bag, making the pickup and maintaining the bag in closed position until the next pickup with the same bag. And a further feature and advantage is that the bag after pickup use may be easily removed manually from the basic structure for disposal without the contents touching or soiling any part of the basic structure nor the person removing the bag.

A primary object of the present invention is the provision of a hand portable and single hand operable device for picking up and transporting animal excrement and the like in a sanitary manner without soiling the basic structure of the device or the person operating the device.

Another object is the provision of a device for picking up and transporting animal excrement and the like which is basically a single component structure with inherent reliability for manipulating a bag to function as a receptacle for pickup and transport of the excrement and the like.

And a further object is the provision of a device for carrying an expendable low cost bag receptacle which may be manually removed from the basic structure for disposal without the contents of the bag ever touching or soiling any part of the basic structure nor the person removing the bag.

Further objects include the provision of a device for picking up and transporting animal excrement and the like which is very light in weight, relatively inexpensive to manufacture and is inherently durable with a long reliable operating life.

These objects, features and advantages of the present invention are achieved generally by the provision of a pair of wire rods fixed sufficiently close together at one end to form a handle portion for grasping both rods with one hand and normally extending outwardly in the form of a V with capacity for deflection toward each other by hand pressure against the rods at the handle portion, and providing a bag support member at the other end of each of the rods for mounting the open end of the bag, each of the bag support members having a straight edge portion at its most distant extremity from the handle portion and extending transversely to the associated rod, the straight edge portions being parallel to each other and moveable toward each other to make line contact with each other by deflection of the rods in response to hand pressure at the handle portion and thereby closing the open end of the bag.

By making the bag support members in the form of wire loop formations, each at the respective other end of each of the rods makes possible a basically single component structure which is light in weight and with ample support for the bag in the pickup and transport functions is thereby achieved.

By making the bag support member of one rod in a plane having a small angle with respect to the associated rod and the other bag support member in a plane having a substantially larger angle with respect to its associated rod thereby permits the one bag support member with its associated bag side wall to operate as a backstop and the other bag support member with its associated bag side wall to operate as a scoop to thereby improve excrement pickup capability of the overall structure.

By making the loop formation of said other bag support member with a configuration having substantially parallel width portions at respective ends of said straight edge portion in said substantially larger angle plane, and a top length portion extending downwardly in a plane different from the plane of said width and straight edge portions, a structure for increasing ease of flow thereover of excrement during the pickup operation is thereby achieved.

By fixing the rods together at the handle end by a wire spring loop with the rods being extensions of the respective ends of the spring loop, deflection range of the rods and associated bag support members is enhanced and a very light and reliable single component basic operating structure is thereby achieved.

By making the bag with opposed side walls at the open end turned inwardly internally of the bag to form a cuff about the open end of the bag and fused at two points separated a distance such as to make firm engagement with the end portions of the bag support members, an effective and inexpensive arrangement for removeably fixing the bag in place on the bag support members is thereby achieved.

These and other objects, features and advantages of the present invention will be better understood from the following description taken in connection with the accompany drawings of preferred embodiments of the invention.

DETAILED DESCRIPTION OF THE PREFERRED EMBODIMENTS

Figures 1, 2, 3, 4, 5, 6, 7, 8, 9, 10:
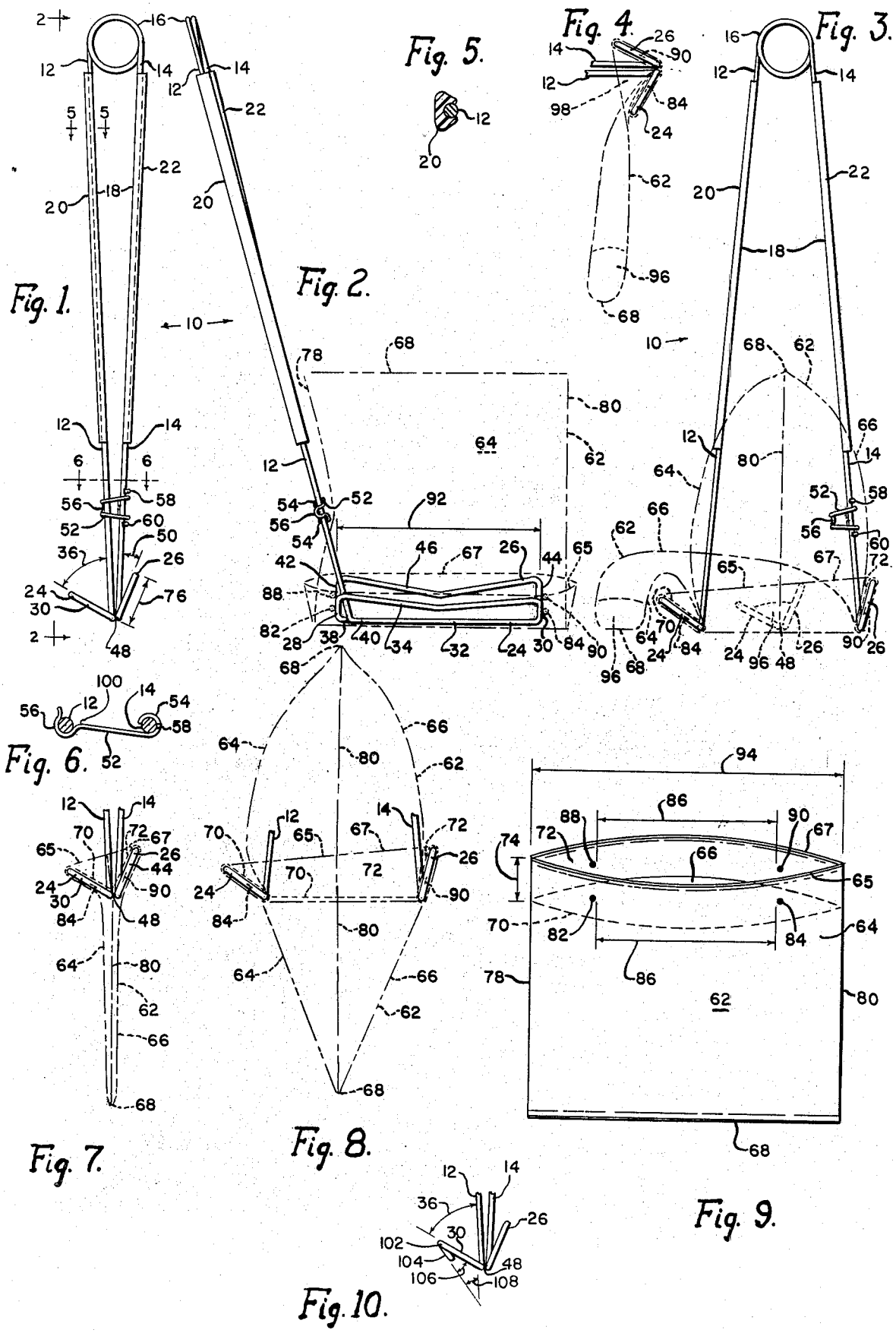
FIG. 1 is a front view of one embodiment of a device for picking up and transporting animal excrement and the like in accordance with the present invention and shown with legs held together in closed position by a spring clip and without a bag in order to more clearly show construction.
FIG. 2 is a side view of the FIG. 1 illustrative embodiment taken on line 2—2 of FIG. 1 and with an empty bag shown in place by broken lines.
FIG. 3 is a front view of the FIG. 1 illustrative embodiment with the legs separated to effect the opening of an empty bag and alternatively a partly filled bag ready for the next pickup shown by broken lines, together with a further showing by broken lines of bag support members brought together in executing an excrement pickup.
FIG. 4 is a front view of the bag support portion of the FIG. 1 illustrative embodiment positioned after a pickup for causing the picked up material to fall into the bag which is shown by broken lines.
FIG. 5 is a cross sectional view to enlarged scale taken on line 5—5 of FIG. 1 to more clearly show construction.
FIG. 6 is a cross sectional view to enlarged scale taken on line 6—6 of FIG. 1 to more clearly show construction.
FIG. 7 is a front view of the bag support portion of the FIG. 1 illustrative embodiment to more clearly show procedure in fixing thereto an empty bag which is shown by broken lines.
FIG. 8 is a front view of the bag support portion and bag of the FIG. 7 illustration shown in open position to more clearly show further procedure in placing the empty bag in position for subsequent pickup operation of the device.
FIG. 9 is an isometric view of a bag structured in accordance with the present invention for attachment and use with the illustrative embodiments.
FIG. 10 is a front view showing an alternative configuration of the bag support portion of the FIG. 1 embodiment and forming a second embodiment of the present invention.

Referring to the drawings in more detail, a hand portable and single hand operable device for picking up and transporting animal excrement and the like in accordance with the present invention is designated generally by the numeral 10. The device 10 has a pair of metal wire rods 12 and 14 normally extending outwardly in the form of a V from the ends of a spring loop 16 at one end of the rods 12 and 14 in the manner shown in FIG. 3. The spring loop 16 holds one end of the rods 12 and 14 sufficiently close together to form a handle portion 18 for grasping with one hand about the handle portion 18 of both rods 12 and 14 which may for hand comfort be covered by plastic handle members 20 and 22 suitably fixed to the rods 12 and 14 respectively.

At the other end of the rods 12 and 14 are bag support members 24 and 26 respectively. The bag support members 24 and 26 are each metal wire elongated similarly shaped loop formations extending transversely from the rods 12 and 14. The bag support loop formation 24 has two parallel width portions 28 and 30 and two length portions 32 and 34 in a single plane which is at about a sixty degree angle 36 (FIG. 1) with respect to the rod 12 for purposes to be hereinafter further described. The bottom of the width portion 28 is bent to align with the length portion 32 and is butt welded at 38 to the bottom end of the rod 12 to form a straight continuation of the length portion 32 which is farthest from the handle 18. The loop formation 24 may be formed by suitably bending an extension of the rod 12 with a single butt weld at position 38, or alternatively the loop formation 24 may be manufactured separately and butt welded to the end of rod 12 at suitable positions such as for example at 38 and 40. In either case the combined rod 12 and bag support member 24 become and operate as a unitary structure.

The bag support loop formation 26 has the same configuration as that of the bag support loop formation 24 and has similar parallel width portions 42 and 44 and upper and lower length portions, with only the upper length portion 46 being visible in FIG. 2, the lower length portion being straight and parallel to the length portion 32 so that they make a line contact 48 when the rods 12 and 14 are deflected as appears in FIG. 1. The plane of the bag loop formation 26 is preferably at an angle 50 with respect to the rod 14 of about twenty degrees (FIG. 1) for purposes to be hereinafter further described.

The rods 12 and 14 may be held together with the bag support members 24 and 26 making line contact 48 by a wire spring clip 52 having a circular formation 54 about the periphery of the rod 14 for rotation about the rod 14. The spring clip 52 has a spring hook formation 56 for manually releasable constraining engagement about rod 12 so as to hold rods 12 and 14 together sufficiently close to make line contact 48 between the straight length portions such as 32 of the bag support loop formations 24 and 26 which are farthest from the handle portion 18 of the device 10. The spring clip 52 while capable of being rotated about the rod 14 is prevented from moving longitudinally of the rod 14 by projections 58 and 60 swaged or otherwise provided at the side of the rod 14.

A bag 62 for use with the device 10 is shown separately in FIG. 9 and is preferably formed of a single sheet of flexible plastic material such as polyethylene about 0.001 to 0.004 inches thick and folded in the middle to form two opposed side walls 64 and 66 emanating from a common fold 68 at one end of the side walls. The other end of the side walls 64 and 66 have folds 65 and 67 inwardly to form cuffs 70 and 72 respectively having a width 74 (FIG. 9) equal to the width 76 (FIG. 1) of the bag support members 24 and 26. The side edges of the bag 62 are fused to form leaktight side seams 78 and 80 and also to fasten the respective ends of the cuffs 70 and 72 to the seams 78 and 80. The cuff 70 is further fastened to the side wall 64 by fused spots 82 and 84 separated a distance 86 and the cuff 72 is further fastened to the side wall 66 by fused spots 88 and 90 also separated a distance 86 which is equal to the length 92 of the bag support members 24 and 26. Thereby, when the bag support loop 24 is inserted between the cuff 70 and side wall 64 with the parallel width portions 28 and 30 being between the fused spots 82 and 84 respectively, a firm frictional gripping by the fused spots 82 and 84 against the width portions 28 and 30 will result. Similarly, upon the insertion of the bag support loop formation 26 between the cuff 72 and side wall 66 with the parallel width portions 42 and 44 between the fused spots 88 and 90, a further firm frictional gripping by the fused spots 88 and 90 against the width portions 42 and 44 will result to effectively hold the bag 62 in place on the bag support members 24 and 26 with the bag sidewalls 64 and 66 hanging down as shown in FIG. 7. Thereafter by relaxing hand pressure on the handle portion 18 with the spring clip 52 being unlatched from rod 12 by swinging it about the rod 14, the spring loop 16 will cause the rods 12 and 14 to swing outwardly until constrained by the bag folds 65 and 67 as determined by the width 94 (FIG. 9) of the bag 62 and the length 92 (FIG. 2) of the bag support members 24 and 26. By way of example and not limitation, for general purposes a practical width 94 of twelve inches and a length 92 of five and one half inches for the bag support members 24 and 26 have been found suitable for most pickup functions.

Having mounted the bag 62 on the bag support members 24 and 26 as shown in FIG. 7 and the bag support members 24 and 26 having been deflected outwardly as shown in FIG. 8, the downwardly hanging bag side walls 64 and 66 may then be manually pushed upwardly between the bag support members 24 and 26 to the inverted sidewall position above the bag support members 24 and 26 as shown in FIG. 8 and in FIGS. 2 and 3. The bag 62 while empty has sufficient rigidity to remain in this ready to use position both while the bag is held open by the bag support members 24 and 26 as shown in FIGS. 8 and 3 and when the bag is held closed as shown in FIG. 2.

The excrement pickup operation is shown in FIG. 3 where under pressure of the operator's hand on the rods 12 and 14 at the handle portion 18 the bag support members 24 and 26 are brought together against excrement 96 or other material to be picked up from the ground or other surface (not shown) as shown by broken lines 24 and 26 in FIG. 3. The large angle 36 causes the bag support member 24 to act as a scoop to effectively reach beneath the material 96 being picked up and move it against the bag support member 26 which because of its smaller angle 50 acts as a backstop to prevent the excrement 96 from passing over the bag support member 26. It will be noted that in this pickup operation the bag sidewalls 64 and 66, as well as cuffs 70 and 72 at all times protect the bag support members 24 and 26 from being soiled by the excrement 96. Also it should be noted that the downward curve of the length portions 34 and 46 of the bag support members 24 and 26 give greater support to the bag side walls and cuffs at the center of the bag support members 24 and 26 where maximum support for picking up the material 96 is needed.

With the bringing of the bag support members 24 and 26 together as shown by the broken lines in FIG. 3, the line contact 48 effectively closes the bag 62 which thereupon permits the device 10 to be lifted by the handle portion 18 to a horizontal position such as shown in FIG. 4 for causing the excrement 96 to fall to the bottom fold 68. Thereafter further pickups may still be made with the same bag 62, in which event the content 96 portion of the bag 62 will be out of the way hanging over the bag support member 24 as shown in FIG. 4 or resting on the ground or other surface (not shown) while the next pickup operation is performed as shown in FIG. 3.

When it is desired to dispose of the bag 62 with its contents 96 without soiling one's hands or the device 10, an easy procedure for removing the bag 62 with its contents from the bag support members 24 and 26 is to hold the rods 12 and 14 in the horizontal position shown in FIG. 4 or in an upside down vertical position (not shown) and manually rupturing the fused spots 82 and 88 by inserting a finger behind the collar at about position 98 in FIG. 4 and pulling the collar in a direction parallel to the planes of the bag support members 24 and 26.

It should be noted that for releasing the rod 12 from the spring clip 52 from the closed position of FIG. 1, all that is needed is hand pressure at the handle portion 18 sufficient to deflect the rod 12 against the curved portion 100 of the spring clip 52 (FIG. 6) and thereby cause the spring clip 52 to swing about the rod 14 and the hook formation 56 to become unlatched from the rod 12. Thus the unlatching function as well as the excrement pickup function of the present invention may be performed as a single hand operation.

In a second embodiment of the present invention, the bag support member 24 is replaced by a bag support member 102 (FIG. 10) whose configuration is the same as that of the bag support member 24 except in that instead of having a downwardly curved top portion such as 34 (FIG. 3) which is in the same plane as the width portions 28 and 30 and bottom portion 32, the bag support member 102 has a top portion 104 curved downwardly in a plane forming an angle 106 of about 25 degrees with respect to the width portions such as 30, and an angle 108 of about 35 degrees with respect to its associated rod 12. Thereby the top portion 104 will support the cuff 70 and side wall 64 of the bag 62 in manner to form a channel which permits easy flow of material pushed toward it by movement of the bag support member 26 during excrement pickup operation such as explained above with respect to FIGS. 1 through 9. The mounting of the bag 62 to the FIG. 10 embodiment and manual operation of the FIG. 10 embodiment is carried out in the same manner as that explained above with respect to FIGS. 1 through 9.

This invention is not limited to the particular details of construction and operation herein described as equivalents will suggest themselves to those skilled in the art. For example, while polyethylene bags have been herein preferred as an inexpensive disposable component, in some instances more permanent bags of such material as rubber which may be cleaned and reused is considered to fall within the equivalents of the present invention. Also, while the wire diameter in the bag support members 24 and 26 is shown in the drawings to be the same as that of the rods 12 and 14, the diameter of the wire in the support members 24 and 26 may be smaller than that in the rods 12 and 14 without being a departure from the present invention.

What is claimed is:

1. In a hand portable device for picking up and transporting animal excrement and the like, the combination of (a) a pair of rods fixed sufficiently close together at one end to form a handle portion for grasping with one hand about both said rods and normally extending outwardly in the form of a V with capacity for deflection toward each other by pressure of said hand against said rods at said handle portion, (b) a bag support member extending from the other end of and transversely to each of said rods and adapted for mounting thereto the respective sides of a bag in a manner that the closed bag end will extend beyond said bag support members on the handle portion side of said support members and and adjacent to the support member side of said rods and with the open end of said bag terminating at the side of said support members opposite said handle portion, (c) each of said bag support members having two substantially parallel width portions and two opposed length portions, one of said length portions being a straight edge portion at the respective bag support member's most distant extremity from said handle portion and extending transversely from the associated rod to form said bag open end terminating side of the respective support member opposite said handle portion, said straight edge portion and width portions being in substantially a single plane and said plane of at least one of said support members being at an angle with respect to its associated rod, and (d) each of said straight edge portions being substantially parallel to each other and moveable toward each other to make line contact with each other by deflection of said rods in response to pressure of said hand against said handle portion for thereby closing said open end of said bag.

2. The combination as in claim 1 wherein said plane of one of said bag support members is at an angle with respect to its associated rod substantially greater than the angle of said plane of the other of said bag support members with respect to the associated rod of said other bag support member.

3. The combination as in claim 2 wherein said angle between said plane of said one support member and its associated rod is about sixty degrees and the angle between said plane of said other support member and its associated rod is about twenty degrees.

4. The combination as in claim 3 including additionally a bag having two opposed side walls and an opening with an internally disposed cuff on the sidewalls at said opening and with each of said support members being between said cuff and the associated side wall of said bag, and means for fixing said cuff and associated side wall frictionally to the associated support member.

5. The combination as in claim 2 wherein a spring loop at said one end of said rods fixes said rods together at said one end and enhances capacity for deflection of said rods under pressure of said hand.

6. The combination as in claim 5 wherein said handle portion of each of said rods is increased in cross sectional size by plastic additions thereto for increased manual comfort.

7. The combination as in claim 2 wherein said bag support members are wire loop formations.

8. The combination as in claim 7 wherein the other of said two opposed length portions of each of said bag support members is curved downwardly toward the center of the associated bag support member and is in the plane of the associated bag support member.

9. The combination as in claim 7 wherein the other of said two opposed length portions of each of said two opposed bag support members is curved downwardly, the one of said other length portions associated with said other bag support member having the smaller angle is in said plane of the bag support member with the smaller angle, and the other of said other length portions is curved downwardly in a plane different from said plane of the bag support member with the larger angle.

10. A receptacle for an excrement pickup device of the type having an opposed pair of bag support members with each being in the form of an elongated wire loop formation having two substantially parallel width portions and two opposed length portions with the width portions and at least one of the length portions being in substantially a single plane, comprising (a) a bag having flexible side walls and an opening substantially longer than the length of said opposed length portions of said elongated wire loop formations, (b) a fold inwardly of said side walls at said opening in the form of a cuff about said opening inside said bag and having a width about equal to the width portions of said wire loop formations, and (c) said cuff being fastened to the side walls at two opposed sides of said bag at positions separated a distance from each other such as to effect a firm frictional contact against the width portions of said elongated wire loop formations and located to position said bag support members centrally of said opening.

11. The receptacle of claim 10 wherein said receptacle is comprised of a 0.001 to 0.004 inch thickness of flexible polyethylene material and said fastening of the cuff to the side walls is in the form of fused portions of the material of said cuff and side walls.

* * * * *